28. Multi-cell furnace in accordance with claim 12, wherein the individual parts of the bi-polar electrode are held together by a holding means which is a poor electrical conductor and which is stable at the temperature of operation.

29. Multi-cell furnace in accordance with claim 28, wherein said holding means consists of boron nitride, silicon nitride, aluminum oxide or magnesium oxide.

30. Multi-cell furnace in accordance with claim 28, wherein said holding means is a frame.

31. Multi-cell furnace in accordance with claim 12, wherein the individual parts of the electrode are operable to be held in place by solidified electrolytic material and insulated in recesses in the furnace lining.

* * * * *

United States Patent [19]

Cramer et al.

[11] 3,930,968

[45] Jan. 6, 1976

[54] PROCESS FOR THE MANUFACTURE OF PHENYLHYDRAZINE

[75] Inventors: Jürgen Cramer, Frankfurt am Main, Germany; Hartmuth Wilhelm Alt, deceased, late of Munich, Germany; by Ortwin Franz Felix Alt, heir, Straubing; by Gudrun Anneiliese Beyer, nee Alt, heir, Hohensachsen, both of Germany

[73] Assignee: Hoechst Aktiengesellschaft, Frankfurt am Main, Germany

[22] Filed: Feb. 1, 1974

[21] Appl. No.: 438,694

[30] Foreign Application Priority Data

Feb. 5, 1973 Germany ..... 2305574

[52] U.S. Cl. ..... 204/74; 204/72; 204/294

[51] Int. Cl.[2] ..... C25B 3/04; C25B 11/02; C25B 11/12

[58] Field of Search ..... 204/72, 74

[56] References Cited

UNITED STATES PATENTS

| | | | |
|---|---|---|---|
| 833,513 | 10/1906 | Dieffenbach | 204/74 |
| 2,069,206 | 2/1937 | Axtell | 204/294 X |
| 3,103,473 | 10/1963 | Juda | 204/77 |
| 3,759,812 | 6/1971 | Koziol et al. | 204/250 |
| 3,836,440 | 9/1974 | Alt et al. | 204/74 |

FOREIGN PATENTS OR APPLICATIONS

| | | | |
|---|---|---|---|
| 1,961,364 | 6/1971 | Germany | 204/74 |

*Primary Examiner*—F. C. Edmundson
*Attorney, Agent, or Firm*—Curtis, Morris & Safford

[57] ABSTRACT

A process for the manufacture of phenylhydrazine by cathodic reduction of diazoaminobenzene dissolved in an electrolyte on solid electrodes with separation of cathode and anode spaces by a diaphragm wherein the diazoaminobenzene solution is electrolyzed in a flow type diaphragm cell at a graphite cathode having a three dimensional surface.

6 Claims, 3 Drawing Figures

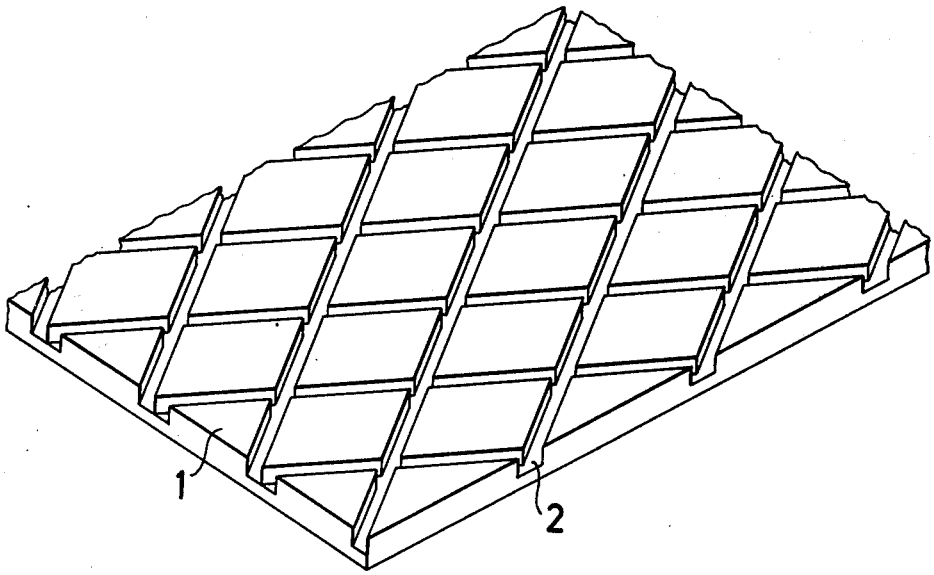

PROCESS FOR THE MANUFACTURE OF PHENYLHYDRAZINE

Figure 1:
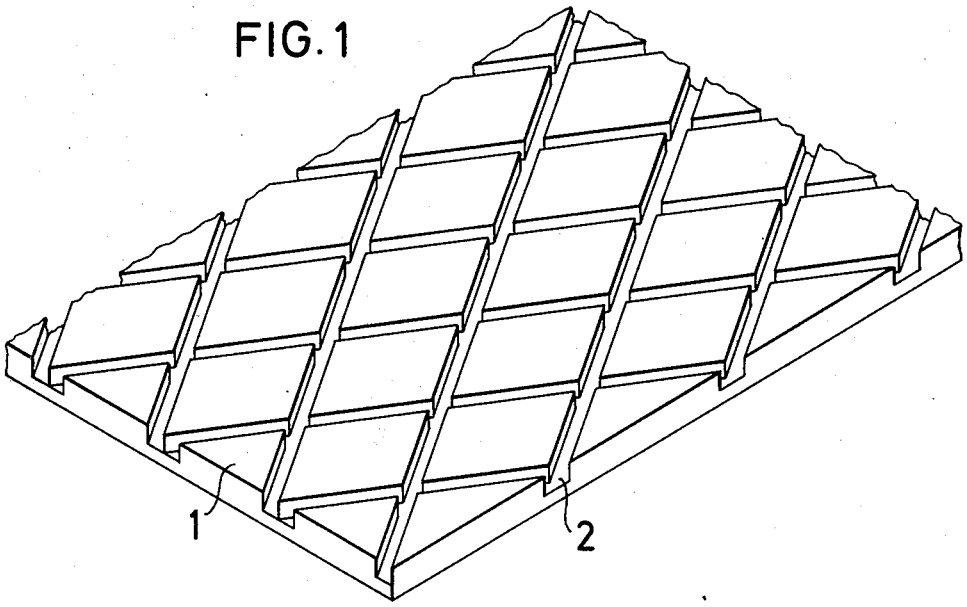
Figure 2:
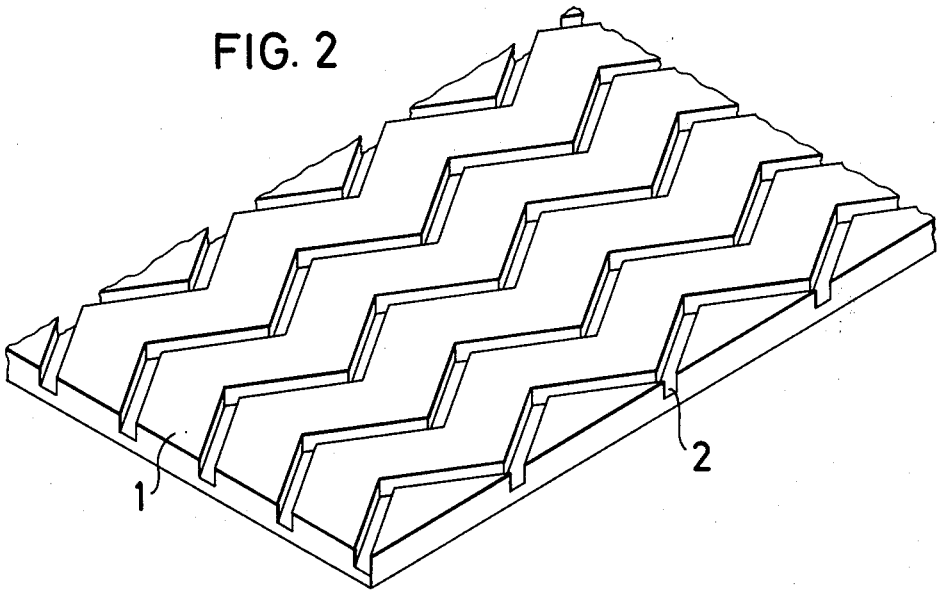
Figure 3:
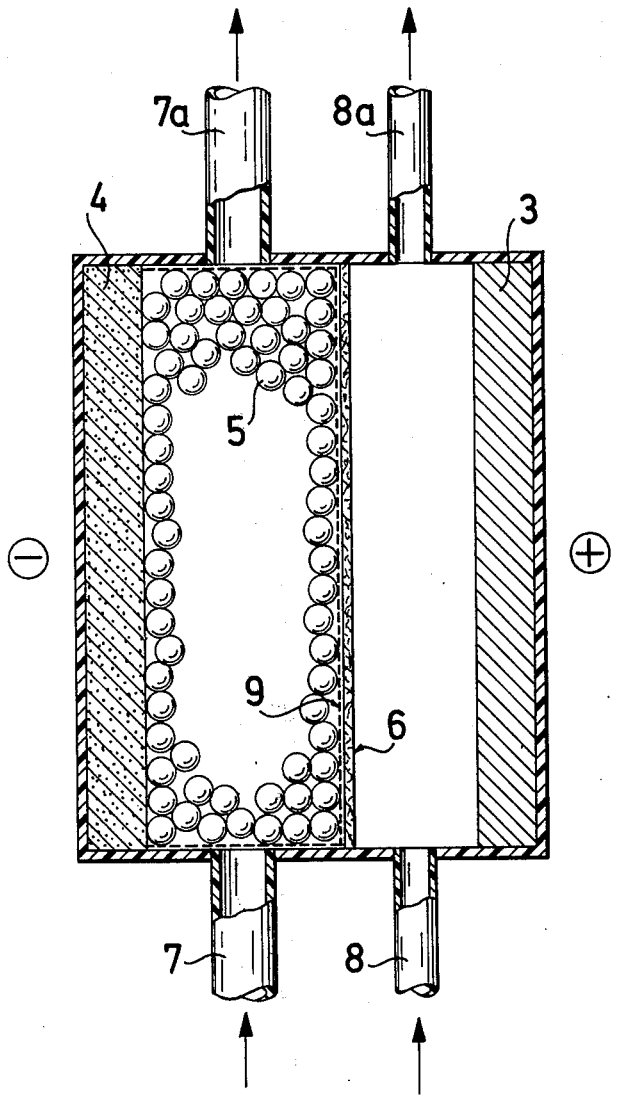

This invention relates to a process for the manufacture of phenylhydrazine.

Our copending Application Ser. No. 307776 now U.S. Pat. 3,836,440 issued Sept. 17, 1974, provides a process for the manufacture of phenylhydrazine from diazoaminobenzene by cathodic reduction with separation of cathode and anode spaces by a diaphragm, wherein diazoaminobenzene, dissolved in an electrolyte, is reduced on solid electrode materials. In a special variant of the process a graphite disc is used as cathode.

Since the thermally sensitive diazoaminobenzene which is unstable in acid solution cannot withstand an acid working up of the electrolysis solution — which is by far the most expedient process for the isolation of the phenylhydrazine, in order to avoid a large decrease in yield it is necessary to reduce cathodically the diazoaminobenzene dissolved in the catholyte completely, i.e. the solution must be subjected to electrolysis until it no longer contains any diazoaminobenzene.

It is known, however, that concentration polarization occurs increasingly during this electrolysis of the solution, i.e. above all towards the end of the electrolysis, so that the cathode potential in the final electrolysis reaches values under constant cell current, which are in the range of those that cause phenylhydrazine scission. This cathodic cleavability of the phenylhydrazine is especially disturbing in the electrosynthesis of phenylhydrazine from diazoaminobenzene, and the problem arises of completely electrolysing diazoaminobenzene solutions at technically interesting current densities of approximately 1000 A/m² and above (at a cell voltage of approximately 4 V) without a part of the phenylhydrazine already formed being split into aniline and ammonia at the same time.

It has now been found that phenylhydrazine can be obtained by cathodic reduction in especially good yields by electrolysing diazoaminobenzene solutions on a graphite cathode with a three dimensional surface in a flow type diaphragm cell.

As graphite cathodes with a three dimensional surface according to the invention preferably masses of loose particles, nets, fabrics or structured plates are used, through the cavities and recesses of which the electrolysis solution flows optionally in a cycle.

On electrodes of this type even towards the end of the reduction, i.e. with low concentration of diazoaminobenzene, no noticeable scission of the phenylhydrazine occurs, which leads to good yields of phenylhydrazine. Since, furthermore, surprisingly with the use of a graphite electrode with a three dimensional surface according to the invention for the cathodic electrolysis of diazoaminobenzene solutions with technically interesting current densities a noticeable hydrogen development begins only toward the end of the electrolysis, not only good yields but also good current efficiencies are obtained.

For the manufacture of graphite electrodes with a three dimensional surface according to the invention, for example, for bulk electrodes, balls, grains, lumps, grit, lamellae, granules, coils of hollow cylinders of from 0.5 mm to 20 mm, preferably from 1.5 mm to 10 mm mean diameter are used, which fill the total cathode space up to the diaphragm. The particles of such a mass or filling consist either completely of graphite or of a non-conducting carrier material which is coated with graphite. The mass is contacted with a current carrying graphite or other current-conducting plate which may be smooth, or contured plate. Suitable graphite nets or grids are the known nets and loose fabrics of graphite fibres or of mixtures of graphite fibres with fibres of inert non-conducting materials or grids of graphite bars of 8 $\mu$ to 4 mm fibre or bar diameter and with mesh widths between 0.2 mm and 10 mm, preferably 0.5 mm to 4 mm mesh width, 10 $\mu$ to 3 mm fibre or bar diameter. As structured graphite plates there are used those which are made by suitable processing, for example by grooving plane plates, or using those which already have the desired surface structures when manufactured. The structured graphite plates of the invention obtained in this way may be irregular or regular, for example, they may have round, oval, rhombic, rectangular or square elevations with any arbitrary means diameters, intervals and heights of these elevations. Mean diameters of from 0.3 mm to 20 mm, intervals of between 0.2 mm and 25 mm and heights of between 0.2 mm and 15 mm, may be used. Especially preferred are mean diameters of from 1.5 mm to 8 mm, intervals of between 1 mm and 6 mm and heights of from 0.5 mm to 8 mm. Those structured plates are preferred, the structures of which have equal heights.

According to the invention the graphite-electrodes with three-dimensional electrode surface are used as cathode in a flow electrolysis cell, the cathode and anode spaces of which are separated from one another by a diaphragm and the electrolysis solution containing the diazoaminobenzene is circulated during the electrolysis through the cathode space and the cavities and recesses of the cathode body. The flow speed is variable within wide limits, preferably, however, in the range of from 0.5 m to 4 m per second.

For a continuous operation of the electro-synthesis of the invention a cascade connection of an unlimited number of flow cells with electrodes of the invention is also possible.

To obtain a cell voltage as low as possible and to protect the diaphragm from mechanical damage the diaphragm is separated from the structured plates, nets or grids or the particles of the bulk electrodes by a fine net of inert, non-conducting material, such as, for example, glass fibres or organic polymer material, such as polyethylene, polyacrylamide, polyacrylonitrile or polyamides (nylon), in such a way that a direct contact of graphite and diaphragm is avoided.

For the anode space a simple common construction approximately in the form of a narrow gap between anode and diaphragm with lateral electrolyte-inlet and outlet is sufficient.

The diaphragm intervals of cathode and anode are not critical and can be designed randomly. They are chosen expediently for economical reasons but are as small as possible.

As diaphragms there are suitable all materials resistant to alkalies, acids and organic solvents, such as, for example, porous ceramic material, felts, porous sheets or permselective membranes, preferably cation exchange membranes.

In contradistinction to the cathodic reduction of diazotates, the electrolysis temperature used in the present process can be varied over a wide range and its upper limit is determined only by the thermal decomposition of the diazoaminobenzene. A temperature in